US007443297B1

(12) United States Patent
Baranowski et al.

(10) Patent No.: US 7,443,297 B1
(45) **Date of Patent: *Oct. 28, 2008**

(54) WIRELESS TRACKING SYSTEM AND METHOD WITH OPTICAL TAG REMOVAL DETECTION

(75) Inventors: Robert Baranowski, San Diego, CA (US); Dyami Caliri, Encinitas, CA (US); Derek Smith, San Diego, CA (US)

(73) Assignee: Awarepoint Corporation, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/967,046

(22) Filed: Dec. 29, 2007

Related U.S. Application Data

(63) Continuation of application No. 11/875,796, filed on Oct. 19, 2007, now Pat. No. 7,336,182.

(51) Int. Cl.
*G08B 13/14* (2006.01)

(52) U.S. Cl. ..... 340/572.1

(58) Field of Classification Search ... 340/572.1–572.9, 340/506, 539.15, 539.13, 539.23, 555, 568.1, 340/522; 250/200
See application file for complete search history.

(56) References Cited

U.S. PATENT DOCUMENTS

| | | | | |
|---|---|---|---|---|
| 5,068,643 | A | 11/1991 | Yashina | |
| 5,475,367 | A * | 12/1995 | Prevost | 340/568.8 |
| 6,806,808 | B1 | 10/2004 | Watters et al. | |
| 6,933,846 | B2 | 8/2005 | Moldavsky et al. | |
| 7,002,473 | B2 * | 2/2006 | Glick et al. | 340/572.1 |
| 7,042,359 | B2 | 5/2006 | Clucas | |
| 7,250,865 | B2 | 7/2007 | Maloney | |
| 2005/0226446 | A1 * | 10/2005 | Luo et al. | 381/312 |

* cited by examiner

*Primary Examiner*—Phung Nguyen
(74) *Attorney, Agent, or Firm*—Clause Eight IPS LLP; Michael Catania; Elaine Lo

(57) ABSTRACT

A wireless tracking system and method with a tag removal detection feature is disclosed herein. The system and method utilize a tag attached to an asset which includes a processor, a motion sensor (such as an accelerometer), a transceiver, a tag removal sensor and a power source having a limited supply of power. The tag removal sensor is an optical sensor which is activated only when the motion sensor detects motion. In this manner, the tag conserves power since the tag is typically only in motion ten percent of the day. If the tag is removed from the asset, the optical sensor confirms the removal and an alert is activated by the system.

20 Claims, 6 Drawing Sheets

WIRELESS TRACKING SYSTEM AND METHOD WITH OPTICAL TAG REMOVAL DETECTION

CROSS REFERENCES TO RELATED APPLICATIONS

The Present application is a continuation application of U.S. patent application Ser. No. 11/875,796, filed on Oct. 19, 2007.

STATEMENT REGARDING FEDERALLY SPONSORED RESEARCH OR DEVELOPMENT

Not Applicable

BACKGROUND OF THE INVENTION

1. Field of the Invention

The present invention is related to wireless tracking systems and methods. More specifically, the present invention relates to a system and method for determining if a tracking tag has been removed from an asset.

2. Description of the Related Art

The ability to quickly determine the location of objects located within a facility is becoming a necessity of life. To the uninformed observer, the placement of transponders, also known as tags, on numerous non-stationary objects whether in an office or home would appear to be an unnecessary use of resources. However, the uninformed observer fails to appreciate the complexity of modern life and the desire for efficiency, whether at the office or home.

For example, in a typical hospital there are numerous shifts of employees utilizing the same equipment. When a new shift arrives the ability to quickly locate medical equipment not only results in a more efficient use of resources, but also can result in averting a medical emergency. Thus, the tracking of medical equipment in a hospital is becoming a standard practice.

The tracking of objects in other facilities is rapidly becoming a means of achieving greater efficiency. A typical radio frequency identification system includes at least multiple tagged objects, each of which transmits a signal, multiple receivers for receiving the transmissions from the tagged objects, and a processing means for analyzing the transmissions to determine the locations of the tagged objects within a predetermined environment. One exemplary method triangulates the strongest received signals to determine the location of a tagged object. This method is based on the assumption that the receivers with the strongest received signals are the ones located closest to the tagged object. However, such an assumption is sometimes erroneous due to common environmental obstacles. Multipath effects can result in a further located receiver having a stronger signal from a tagged object than a more proximate receiver to the tagged object, which result in a mistaken location determination.

Yashina, U.S. Pat. No. 5,068,643, for a Burglarproof Device, discloses a device that includes a vibration sensor and an optical sensor. When the vibration sensor is activated, by vibration, a signal is sent to the optical sensor to determine the level of ambient light from relative brightness to relative darkness. If the ambient level is too dark, an alarm circuit is activated on the device to indicate that the goods to which the device is attached has been placed under or in a thief's clothing.

Watters, et al., U.S. Pat. No. 6,806,808, for a Wireless Event-Recording Device With Identification Codes, discloses a passive transponder that has a sensor for detecting a physical or chemical event or state without using a power source of its own.

Glick, et al., U.S. Pat. No. 7,002,473, for a Loss Prevention Device, discloses placing a RFID tag on an article and periodically interrogating each RFID tag to determine if the tag is still within a predetermined zone.

Clucas, U.S. Pat. No. 7,042,359, for a Method And Apparatus To Detect A Plurality Of Security Tags discloses an electronic article surveillance system which includes a multitude of expensive RFID tags attached to expensive goods and a multitude of inexpensive RFID tags attached to inexpensive goods, and means to distinguish between the types of tags.

Although the prior art has provided numerous solutions to prevent the theft of goods, the prior art has yet to resolve tag removal issues associated with location asset tracking. Further, the prior art has failed to recognize the problems associated with wireless location asset tracking.

BRIEF SUMMARY OF THE INVENTION

The present invention has recognized that tag removal in a wireless location asset tracking system complicates the asset tracking function of the system since additional components must be added to an already power exhausted and space restricted tag. The present invention is able to provide a solution that resolves the space restriction and power consumption issues.

The present invention restricts the activity of the tag removal sensor by only activating the tag removal sensor when the possibility of the tag being removed is very high. This high possibility activation is performed by a motion sensor controlling the activation of the tag removal sensor through a processor. When the motion sensor registers motion, a signal is sent to the processor to activate the tag removal sensor to determine if the tag is still attached to the asset. In this manner, the power supply of the tag is conserved, while the tag removal function is optimized.

One aspect of the present invention is a method for determining if a tracking tag has been removed from an asset within an indoor facility. The method includes tracking a location of an asset bearing a tag. The tag includes a processor, a motion sensor, a transceiver, a tag removal sensor, and a power source having a limited supply of electrical power. The motion of the tag is detected by the motion sensor and communicated to the processor. An activation signal is activated from the processor to the tag removal sensor. The activation signal activates the tag removal sensor from a low power consumption state to an activation state. The tag removal sensor is an optical sensor that emits light from the tag to the asset and receives the light reflected from a surface of the asset indicating that the tag is attached to the asset. The method includes determining if the tag is currently attached to the asset. The method includes transmitting an unattached signal from the tag removal sensor to the processor and from the processor to the transceiver to indicate that the tag is currently unattached to the asset. The method includes broadcasting the unattached signal from the transceiver of the tag to a plurality of network sensors positioned within an indoor facility. The method includes transmitting the unattached signal from at least one of the plurality of network sensors to a positioning engine to generate a warning.

Another aspect of the present invention is a tracking and security device comprising a microcontroller, a wireless network interface, a power supply, a motion sensor and a tag removal sensor. The tag also includes a housing for protecting the components of the tag. The optical sensor includes an emitter for emitting a light beam through a window of the housing of the tag. The optical sensor also includes a photodiode for receiving a reflected light beam generated by the emitter. The optical sensor has a resting mode to conserve power consumption and an activation mode to determine if the tag is attached to an object. During the activation mode, the emitter generates the light beam which is reflected off a reflective panel of an asset and received by the photodiode if the tag is attached to the object. The optical sensor has means for informing the microcontroller that the tag is attached to the asset. The motion sensor has means for transmitting a signal to the microcontroller when the tag is in motion. The microcontroller activates the optical sensor when the motion sensor transmits a motion signal. The wireless network interface transmits a broadcast from the tag using a wireless communication format. The microcontroller has means for transmitting at a motion rate and at a stationary rate. The housing is preferably composed of a hard plastic material and the window is preferably transparent.

Another aspect of the present invention is a system for determining if a tracking tag has been removed from an asset within an indoor facility. The system comprises a plurality of sensors, a positioning engine, a plurality of assets with each of the assets having a tag with a tag removal sensor, and a plurality of access points for receiving the signals from the plurality of sensors and transmitting the signals to the positioning engine. Each tag of each of the plurality of assets has means for determining if the tag has been removed from the asset, and means for broadcasting a signal to each of the plurality of sensors. The positioning engine includes means for tracking each asset within the indoor facility and means for warning an operator of the system if a tag is removed from an asset.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
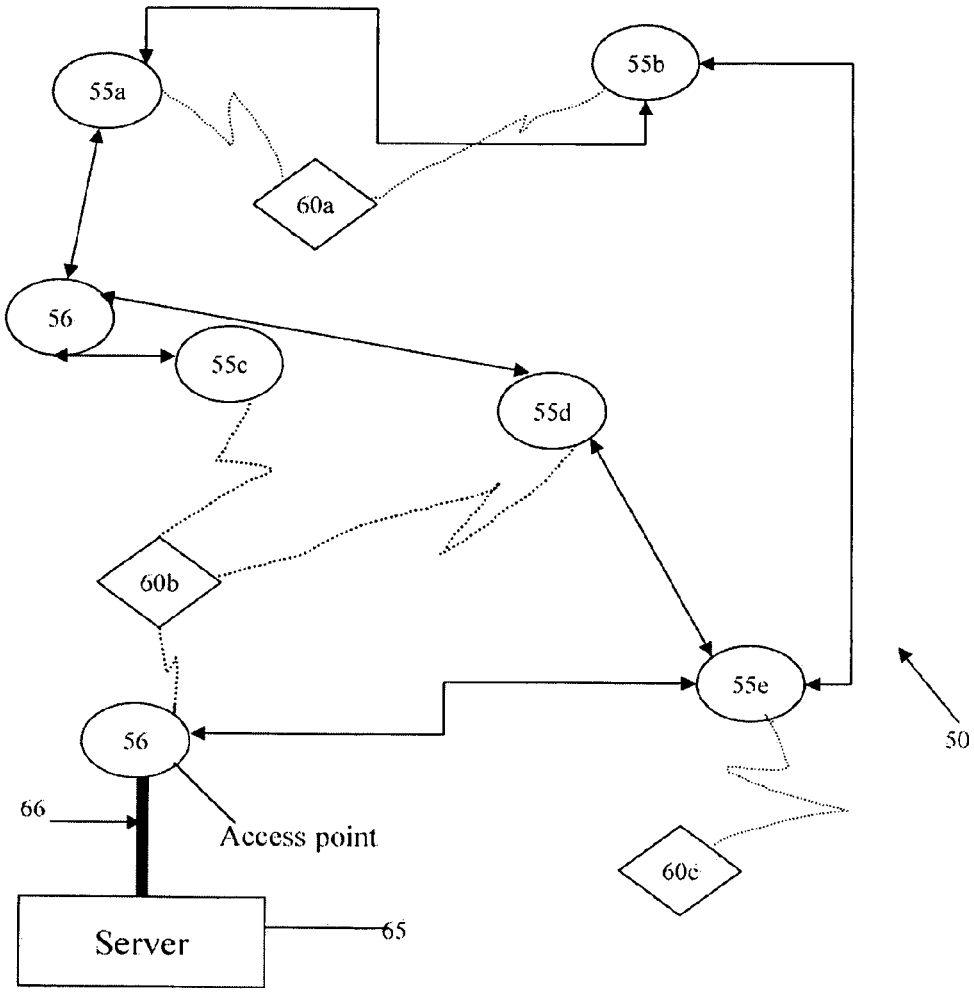
FIG. 1 is schematic view of a wireless asset tracking system.
Figure 2:
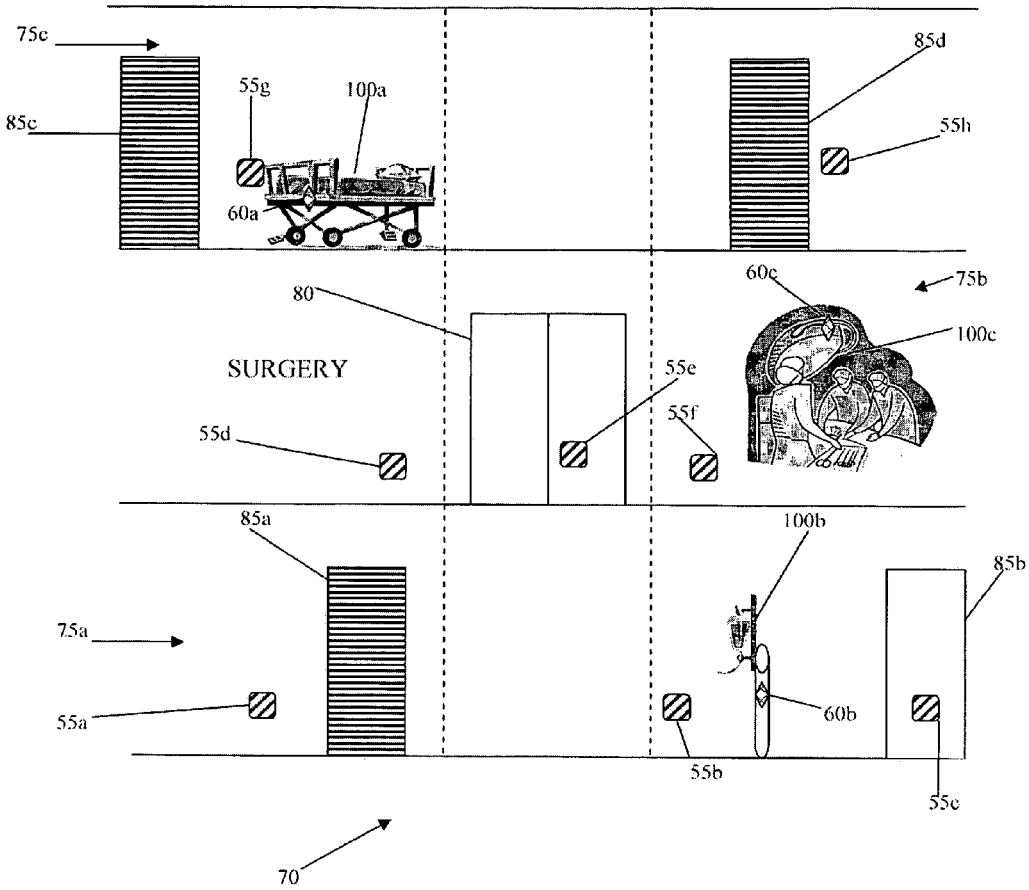
FIG. 2 is a multi-floor view of a facility employing a wireless asset tracking system.
Figure 3:
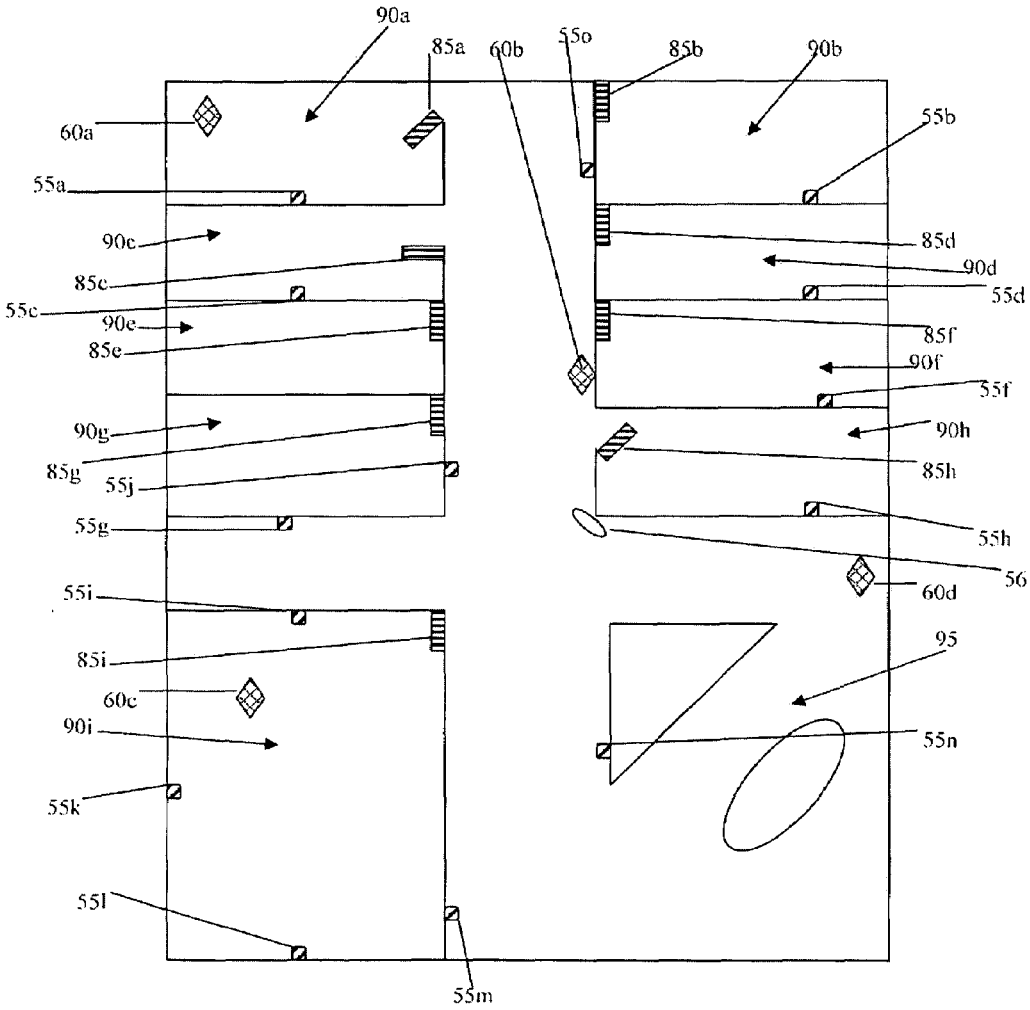
FIG. 3 is a floor plan view of a single floor in a facility employing a wireless asset tracking system.

As shown in FIGS. 1-3, a wireless asset tracking system is generally designated 50. The system 50 is capable of determining real-time location of an asset 100 within an indoor facility 70. The system 50 preferably includes a plurality of sensors 55, a plurality of bridges 56, a plurality of tags 60 and at least one server 65. One example of the components of the system 50 is disclosed in U.S. patent application Ser. No. 10/968,814, filed on Oct. 18, 2004 for a Wireless Position Location And Tracking System, which is hereby incorporated by reference in its entirety. A more specific example of the sensors 55 is disclosed in U.S. patent application Ser. No. 11/008,802, filed on Dec. 8, 2004 for a Plug-In Network Appliance, which is hereby incorporated by reference in its entirety. Another example of a system 50 is set forth in U.S. Pat. No. 6,751,455 for a Power-And Bandwidth-Adaptive In-Home Wireless Communications System With Power-Grid-Powered Agents And Battery-Powered Clients, which is hereby incorporated by reference in its entirety.

The system 50 is preferably employed within an indoor facility 70 such as a business office, factory, home, hospital and/or government agency building. The system 50 is utilized to track and locate various assets (objects) positioned throughout the facility 70. The tags 60 preferably continuously transmit signals on a predetermined time cycle, and these signals are received by sensors 55 positioned throughout the facility 70. In a preferred embodiment, the tags 60 transmit a single every five seconds when in motion, and a signal every ten minutes when stationary. The sensors 55 preferably transmit the data to a bridge 56 for transmission to a server 65. If a sensor 55 is unable to transmit to a bridge 56, the sensor 55 may transmit to another sensor 55 in a mesh network-like system for eventual transmission to a bridge 56. In a preferred embodiment, a transmission may be sent from a transmission distance of six sensors 55 from a bridge 56. The server 65 preferably continuously receives transmissions from the sensors 55 via the bridges 56 concerning the movement of assets 100 bearing a tag 60 within the facility 70. The server 65 processes the transmissions from the sensors 55 and calculates a real-time position for each of the assets 100 bearing a tag 60 within the facility 70. The real-time location information for each of the assets 100 bearing a tag 60 is preferably displayed on an image of a floor plan of the indoor facility 70, or if the facility 70 has multiple floors, then on the floor plan images of the floors of the facility 70. The floor plan image may be used with a graphical user interface so that an individual of the facility 70 is able to quickly locate assets 100 within the facility 70.

The assets 100 are preferably items of value to the owners or users of the system 50 and/or the facility 70. In a hospital setting, the assets 100 could include vital sign monitoring devices, kidney dialysis machines, imaging devices, and other like items that are valuable and mobile. In an office setting, the assets 100 could be computers, copiers, printers, and like devices. Those skilled in the pertinent art will recognize that the assets are anything of value to a user and mobile.

As shown in FIG. 1, the system 50 utilizes sensors 55 to monitor and identify the real-time position of non-stationary assets 100 bearing or integrated with tags 60. The sensors 55*a-f* preferably wirelessly communicate with each other (shown as double arrow lines) and with a server 65 through a wired connection 66 via at least one bridge 56, such as disclosed in the above-mentioned U.S. patent application Ser. No. 11/008,802, filed on Dec. 8, 2004 for a Plug-In Network Appliance. The tags 60*a-c* transmit signals (shown as dashed lines) which are received by the sensors 55*a-e*, which then transmit signals to bridges 56 for eventual transmission to a server 65. The server 65 is preferably located on-site at the facility 70. However, the system 50 may also include an off-site server 65, not shown.

Each tag 60 preferably transmits a radio frequency signal of approximately 2.48 GigaHertz ("GHz"). The communication format is preferably IEEE Standard 802.15.4. Those skilled in the pertinent art will recognize that the tags 60 may operate at various frequencies without departing from the scope and spirit of the present invention.

As shown in FIGS. 2-3, the facility 70 depicted is a hospital. The facility 70 has a multitude of floors 75*a-c*. An elevator 80 provides access between the various floors 75*a*, 75*b* and 75*c*. Each floor 75*a*, 75*b* and 75*c* has a multitude of rooms

90*a-i*, with each room 90 accessible through a door 85. Positioned throughout the facility 70 are sensors 55*a-o* for obtaining readings from tags 60*a-d* attached to or integrated into non-stationary assets 100*a*, 100*b* (see FIGS. 2 and 4). A bridge 56 is also shown for receiving transmissions from the sensors 55 for processing by the server 65.

Figure 4:
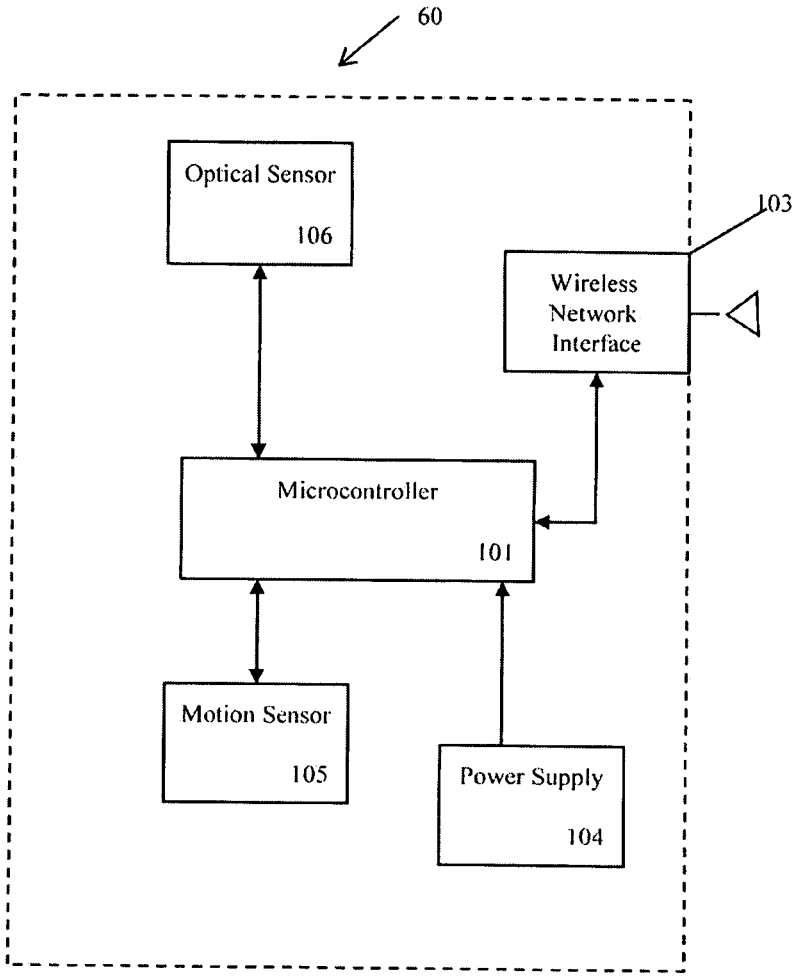
FIG. 4 is a block diagram of a tag.

As shown in FIG. 4, a tag 60 preferably includes a microcontroller or processor 101, a wireless network interface 103 having an antenna, a power supply 104, a motion sensor 105 and an optical sensor 106. The processor 101 is in communication with the optical sensor 106, motion sensor 105 and wireless network interface 103. The power supply 104 preferably provides power to the processor 101, the motion sensor 104, the optical sensor 106 and the wireless network interface 103. The power supply 104 is preferably a battery such as a lithium battery. The power supply 104 is preferably the only source of power for the tag 60. Conserving the energy use of the tag 60 allows the tag 60 to have greater use period before needing to be recharged or replaced. In order to conserve the energy use of the tag 60, it is preferably to activate the motion sensor 105 and the optical sensor 106 only when necessary. Preferably the components of the tag are enclosed within a housing indicated by the dashed line. Preferably a transparent window is positioned by the optical sensor 106.

A preferred optical sensor 106 is a TCND5000 from VISHAY SEMICONDUCTORS, which is a reflective optical sensor with PIN photodiode output. The emitter 107 is preferably an infrared emitter having a wavelength of approximately 940 nanometers ("nm"). The emitter 107 preferably has a voltage of 5 Volts, a peak current of 500 milliAmps, and a power dissipation of 190 milliWatts. The photodiode 108, or detector, preferably has a voltage of 60 Volts and a power dissipation of 75 milliWatts. A marking area of the optical sensor 106 preferably separates the emitter 107 from the photodiode 108. The optical sensor 106 preferably has dimensions of a length of 6 millimeters ("mm"), a height of 4.3 mm and a width of 3.75 mm. The photodiode 107 preferably has a spectral range of 840 nm to 1050 nm. Those skilled in the pertinent art will recognize that other optical sensors may be used without departing from the scope and spirit of the present invention.

Figure 5:
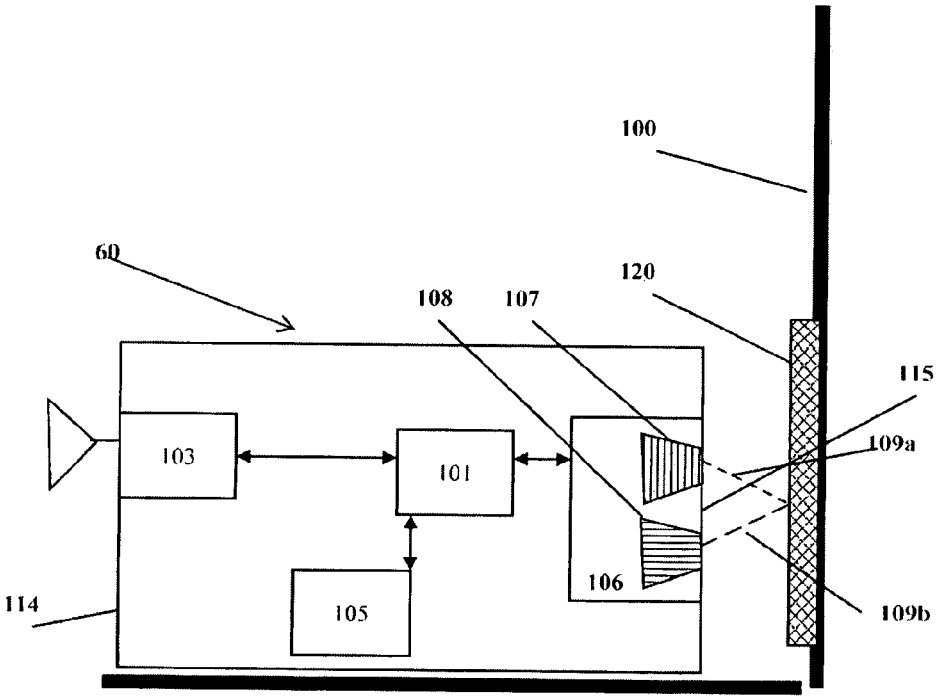
FIG. 5 is a schematic diagram of a tag attached to an object.

As shown in FIG. 5, when the optical sensor 106 is in its activation mode, an emitter 107 of the optical sensor 106 transmits a light beam 109*a* through a window 115 of the tag 60 towards a reflective panel 120 attached to the asset 100. The transparent window 115 is positioned on a housing 114 of the tag 60 by the emitter 107 and the photodiode 108. The reflective panel 120 is preferably positioned from 2 mm to 25 mm, and most preferably approximately a distance of 6 mm from the emitter 107. The reflective panel 120 is preferably a KODAK grey card having 20% reflectivity. The reflective panel 120 preferably has a length of approximately 30 mm. The transmitted light beam 109*a* strikes the reflective panel 120 and a reflected light beam 109*b* is received by a photodiode 108 of the optical sensor 106. In this manner, the optical sensor 106 is able to determine if the tag 60 is attached to the asset 100. If the tag 60 were removed, the transmitted light beam 109*a* would not strike a reflective panel 120 and a reflected light beam 109*b* would not be received by the photodiode 108. The failure of the photodiode 108 to receive the reflected light beam 109*b* would result in an unattached signal sent from the optical sensor 106 to the processor 101. The signals preferably sent from the optical sensor 106 to the processor 101 are simple ones (is) and zeros (0s). If the tag 60 is attached, a 1 is sent from the optical sensor 106 to the processor 101. If the tag 60 is unattached, a 0 is sent from the optical sensor 106 to the processor 101.

Reducing the power consumption of the tag 60 is an important aspect of the present invention. Typically, an asset 100 bearing a tag 60 is in motion ten percent of the day. The optical sensor 106 is only in its activation mode when the tag 60 is in motion as indicated by the motion sensor 105. Thus, ninety percent of the day, the optical sensor 106 is in a resting mode and using little or no energy from the power supply 104. When the tag 60 is in motion, the optical sensor 106 is preferably queried every five seconds by the processor 101 concerning the attachment of the tag 60 to the asset 100. When the tag 60 is stationary, the optical sensor 106 is in its resting mode and not queried by the processor 101. By operating in this manner, the power efficiency of the tag 60 is ten times greater than constantly querying the optical sensor 106 throughout the day concerning the attachment status of the tag 60. However, the tag 60 is still able to provide continuous security monitoring since the motion sensor 105 transmits a motion signal when motion of the tag 60 is detected thereby resulting in an activation signal transmitted from the processor 101 to the optical sensor 106.

In one preferred embodiment, the optical sensor 106 consumes 3 milli-amps-milli-seconds of power from the power supply 104 when the optical sensor 106 is in the activation mode. On a per day power consumption, the optical sensor 106 consumes 0.0018 milli-amps-hours/day.

Figure 6:
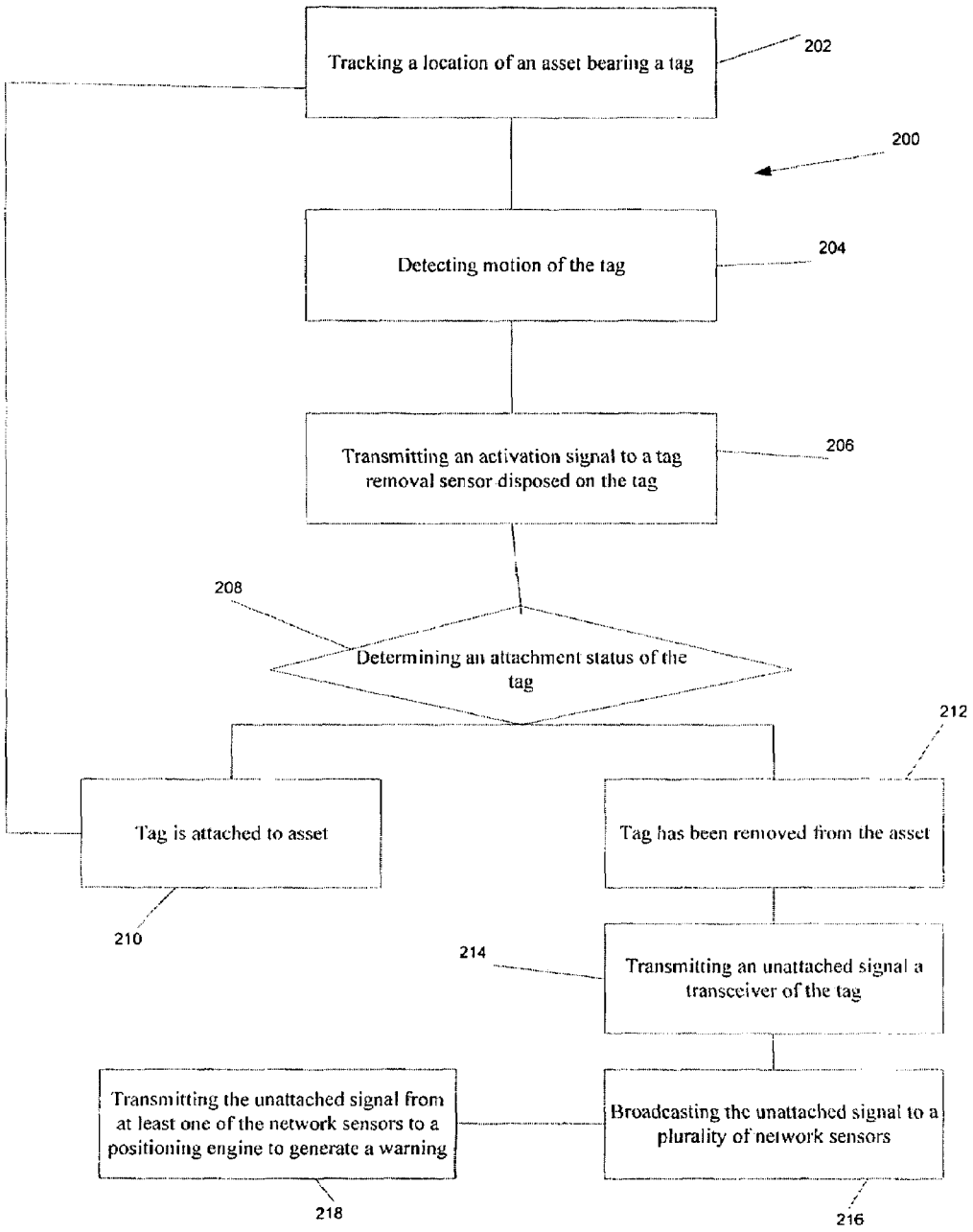
FIG. 6 is a flow chart of a method of the present invention.

A method 200 of the present invention is illustrated in FIG. 6. At block 202, the tracking of a location of an asset 100 bearing a tag 60 is performed by the sensors 55 of the system 50 which receive readings from each tag 60. For location tracking, a sensor 55 receives a signal which includes reading inputs from a tag 60. The reading inputs from the tag 60 preferably include the tag identification, the signal strength, the link quality and the time of the reading, all of which are inputted as a single sensor reading. In this manner, the system is able to track the location of the asset 100 bearing the tag 60. At block 204, motion is detected by the motion sensor 105 of the tag 60, which transmits a signal to the processor 101. The motion could be the asset 100 being moved from one location to another, or the motion could be the removal of the tag 60 from the asset 100. At block 206, an activation signal is transmitted from the processor 101 to the tag removal sensor 106, which is an optical sensor 106. The activation signal activates the optical sensor 106 from a low power or resting mode to a high power or activation mode. In this manner, the limited power supply 104 of the tag 60 is not quickly exhausted by having the optical sensor 106 in a constant high power activation mode. At decision 208, a determination is made concerning the attachment status of the tag 60. This determination is performed by the reflected light 109*b* of the emitter 107 being received by the photodiode 108. If the reflected light 109*b* is received by the photodiode 108, then at block 210, a signal is sent that the tag 60 is attached to the asset 100, and the tag 60 continues to broadcast location readings to the sensors 55. If the reflected light 109*b* is not received by the photodiode 108, then at block 212, a signal is sent from the optical sensor 106 to the processor 101 that the tag 60 has been removed from the asset 100. At block 214, the processor 101 transmits an unattached signal through the wireless network interface 103, which at block 216 is broadcast to the plurality of network sensors 55 of the system 50. At block 218, at least one of the plurality of network sensors 55 transmits the unattached signal to the positioning engine 65 which generates an alert warning to the users of the system 50 informing the users that a tag 60 has been removed from an asset 100.

In the above-described manner, the tag 60 can operate longer on its limited power supply 104 while providing an optimized tag removal security function.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

We claim:

1. A method for determining if a tracking tag has been removed from an asset, the method comprising:

detecting motion of a tag with a motion sensor provided on the tag, the tag attached to an asset;

transmitting an activation signal to a tag removal sensor disposed on the tag, the activation signal activating the tag removal sensor from a low power consumption state;

determining if the tag is currently attached to the asset;

transmitting an unattached signal to a transceiver of the tracking tag to indicate that the tracking tag is currently unattached to the asset;

broadcasting the unattached signal to a plurality of network sensors positioned within an indoor facility; and transmitting the unattached signal from at least one of the plurality of network sensors to a positioning engine to generate a warning.

2. The method according to claim 1 wherein the tag removal sensor is an optical sensor that emits light from the tracking tag to the asset and receives the light reflected from a surface of the asset indicating that the tracking tag is attached to the asset.

3. The method according to claim 1 further comprising tracking a location of the asset bearing a tag by transmitting a radiofrequency signal from the tag at a first periodic basis when the tag is in a resting state and at a second periodic basis when the tag is in a motion state.

4. The method according to claim 3 wherein the first periodic basis is every eight minutes and the second periodic basis is every five seconds.

5. The method according to claim 1 wherein the warning is a display on a graphical user interface.

6. The method according to claim 1 wherein the warning is an email message to at least one operator.

7. The method according to claim 1 wherein the warning is a SMS to at least one operator.

8. The method according to claim 1 wherein the tracking tag further comprises a power source having a limited supply of electrical power.

9. The method according to claim 1 wherein the tracking tag transmits a radiofrequency transmission of approximately 2.48 GigaHertz, and each of the plurality of network sensors communicates utilizing a 802.15.4 protocol.

10. A system for determining if a tracking tag has been removed from an asset, the system comprising:

a plurality of network sensors, each of the plurality of network sensors positioned within an indoor facility;

a tracking tag attached to an asset, the tracking tag comprising means for detecting motion of the tracking tag, a tag removal sensor activated from a low power consumption state to an activation state upon a signal from the motion detecting means, means for wirelessly transmitting to each of the plurality of network sensors a signal that the tracking tag has been removed from the asset; and means for processing the signals from the tracking tag.

11. The system according to claim 10 wherein the motion detection means comprises an accelerometer.

12. The system according to claim 10 wherein the tag removal sensor is an optical sensor including an emitter for emitting a light beam, and a photodiode for receiving a reflected light beam.

13. The system according to claim 12 wherein during the activation state the emitter generates the light beam, the light beam is reflected off the asset and the reflected light beam is received by the photodiode if the tracking tag is attached to the asset.

14. The system according to claim 12 wherein the wirelessly transmitting means comprises a radiofrequency transmitter, the wirelessly transmitting means transmitting a radiofrequency from the tracking tag to the plurality of network sensors at a first periodic basis when the tag is in a stationary state and at a second periodic basis when the tag is in a motion state.

15. The system according to claim 14 wherein the second periodic basis is substantially more frequent than the first periodic basis.

16. A tracking and security device for monitoring a location and status of an asset in an indoor facility, the device comprising:

a housing having a window;

a microcontroller positioned within the housing, the microcontroller having means for transmitting at a motion rate and at a stationary rate;

a wireless network interface positioned within the housing and connected to the microcontroller, the wireless network interface transmitting a broadcast from the device using a wireless communication format;

a power supply positioned within the housing and connected to the microcontroller;

a motion sensor positioned within the housing and connected to the microcontroller, the motion sensor having means for transmitting a signal to the microcontroller when the device is in motion; and an optical sensor positioned within the housing, the optical sensor comprising an emitter for emitting a light beam through the window of the housing of the device, and a photodiode for receiving a reflected light beam generated by the emitter, the optical sensor having a resting mode to conserve power consumption and an activation mode to determine whether the device is attached to an asset, wherein during the activation mode the emitter generates the light beam which is reflected off the asset and received by the photodiode if the device is attached to the asset, the optical sensor further comprising means for informing the microcontroller that the device is attached to the asset.

17. The device according to claim 16 wherein the means for transmitting at a stationary rate occurs at a first periodic basis, the means for transmitting at a motion rate occurs at a second periodic basis, and wherein the second periodic basis is substantially more frequent than the first periodic basis.

18. The device according to claim 16 wherein the means for transmitting comprises a radiofrequency transmitter.

19. The device according to claim 16 wherein the motion sensor is an accelerometer.

20. The device according to claim 16 wherein the indoor facility is a hospital.

* * * * *